US007942984B2

(12) United States Patent
Ishiguro et al.

(10) Patent No.: US 7,942,984 B2
(45) Date of Patent: May 17, 2011

(54) STEEL PIPE WITH GOOD MAGNETIC PROPERTIES AND METHOD OF PRODUCING THE SAME

(75) Inventors: Yasuhide Ishiguro, Chiyoda-ku (JP); Yoshikazu Kawabata, Chiyoda-ku (JP); Kei Sakata, Chiyoda-ku (JP); Masayuki Sakaguchi, Chiyoda-ku (JP); Masayoshi Ishida, Chiyoda-ku (JP); Motoaki Itadani, Chiyoda-ku (JP); Yasue Koyama, Chiyoda-ku (JP)

(73) Assignee: JFE Steel Corporation (JP)

( * ) Notice: Subject to any disclaimer, the term of this patent is extended or adjusted under 35 U.S.C. 154(b) by 774 days.

(21) Appl. No.: 11/791,503

(22) PCT Filed: Sep. 1, 2005

(86) PCT No.: PCT/JP2005/016472

§ 371 (c)(1), (2), (4) Date: May 24, 2007

(87) PCT Pub. No.: WO2006/057098

PCT Pub. Date: Jun. 1, 2006

(65) Prior Publication Data

US 2008/0011389 A1 Jan. 17, 2008

(30) Foreign Application Priority Data

Nov. 26, 2004 (JP) ..... 2004-342024

(51) Int. Cl.
*H01F 1/147* (2006.01)

(52) U.S. Cl. ..... 148/306; 148/120; 148/520

(58) Field of Classification Search ..... None
See application file for complete search history.

(56) References Cited

U.S. PATENT DOCUMENTS

2002/0153070 A1 10/2002 Toyooka et al.

FOREIGN PATENT DOCUMENTS

| | | | |
|---|---|---|---|
| AP | 2000096142 | | 4/2000 |
| EP | 0 940 476 | A | 9/1999 |
| EP | 1 264 910 | A1 | 12/2002 |
| EP | 1 437 422 | A1 | 7/2004 |
| JP | 2-159321 | A | 6/1990 |
| JP | 2-159321 | A | 6/1990 |
| JP | 2-236226 | A | 9/1990 |
| JP | 2-236226 | A | 9/1990 |
| JP | 2-259047 | A | 10/1990 |
| JP | 2-259047 | A | 10/1990 |
| JP | 7-68579 | A | 3/1995 |
| JP | 2000096143 | | 4/2000 |
| JP | 2001-303130 | A | 10/2001 |
| JP | 2001303130 | | 10/2001 |
| WO | WO 01/62998 | A1 | 8/2001 |

*Primary Examiner* — John P Sheehan
(74) *Attorney, Agent, or Firm* — DLA Piper LLP (US)

(57) ABSTRACT

A steel pipe blank having a composition containing 0.5% or less C and 85% or more Fe in terms of mass percent is heated, and stretch-reducing is then performed so that the diameter decrease ratio is 15% or more and the rolling finishing temperature is (the $Ar_3$ transformation point−10)° C. or lower. Consequently, a structure in which the ratio of X-ray diffraction intensity obtained from the plane in which the <100> direction of crystal grains is preferentially oriented parallel to the circumference direction and the <011> direction of crystal grains is preferentially oriented parallel to the rolling direction of the steel pipe to that obtained for a three-dimensionally randomly oriented sample is 3.0 or more is formed, and the r-value is increased, thereby improving the magnetic properties of the steel pipe.

6 Claims, No Drawings

STEEL PIPE WITH GOOD MAGNETIC PROPERTIES AND METHOD OF PRODUCING THE SAME

RELATED APPLICATION

This is a §371 of International Application No. PCT/JP2005/016472, with an international filing date of Sep. 1, 2005 (WO 2006/057098 A1, published Jun. 1, 2006), which is based on Japanese Patent Application No. 2004-342024, filed Nov. 26, 2004.

TECHNICAL FIELD

The technology herein relates to steel pipes with good magnetic properties that is suitable for use in a magnetic shield, a stator of a motor, a rotor, and the like and methods of producing the same.

BACKGROUND

Thin steel sheets and thick steel sheets with good magnetic properties have been used for magnetic shields, stators of motors, rotors, and so forth. Examples of materials with good magnetic properties include non-oriented electrical steel sheets in which the axis of easy magnetization <100> is oriented in random directions in the plane and grain-oriented silicon steel sheets in which the axis of easy magnetization <100> is preferentially oriented parallel to the rolling direction.

However, when these steel sheets with good magnetic properties are used for, for example, a magnetic shield, it is necessary to perform steps of processing the steel sheets, joining the steel sheets by electric resistance welding or the like, and assembling the steel sheets to form a desired shape. When these steel sheets are used for a stator of a motor or a rotor, the steel sheets are punched out and a plurality of sheets are laminated for use. In such a case, steps such as a punching process and a lamination process are required. Accordingly, the use of a steel sheet as a blank is disadvantageous in that complex steps are required and that an irregular area at an electric-resistance-welding area and so on is formed, resulting in degradation of magnetic properties. In order to prevent such a problem, the use of a steel pipe as a blank has also been studied.

Steel pipes with good magnetic properties may be produced by electric resistance welding of electrical steel sheets. However, the electric resistance welding of electrical steel sheets is difficult because of a high Si content of the electrical steel sheets. Furthermore, magnetic properties at the electric-resistance-welding area are degraded. Alternatively, seamless steel pipes may be produced using electrical steel billets, but it is difficult to perform the process of pipe production because electrical steels have low ductility.

To solve the above problems, for example, Japanese Unexamined Patent Application Publication No. 2-236226 proposes a method of producing an electrical steel pipe in which a steel having high Si and Al contents is used, a seamless pipe is formed by hot extrusion and hot rolling under appropriate conditions, the seamless pipe is rolled at the recrystallization temperature or a lower temperature, and final annealing is performed. However, the technique described in Japanese Unexamined Patent Application No. 2-236226 is disadvantageous in that the hot extrusion process is essential, thereby increasing the production cost.

Japanese Examined Patent Application Publication No. 7-68579 proposes a method of producing an electrical steel pipe in which a steel slab or a cast slab having a steel composition containing 99.5% or more of iron (Fe) and the balance being impurities is heated to 1,100° C. to 1,350° C. and hot rolling is performed to prepare a blank, a pipe is then produced, and the pipe is heat-treated at 500° C. to 1,000° C. According to the technique described in Japanese Examined Patent Application Publication No. 7-68579, a steel pipe having satisfactory properties for a magnetic shield is produced. However, in this technique, grain growth is merely induced by the heat treatment, and crystal orientations are not considered. Therefore, the properties of this steel pipe are not satisfactory for applications in which excellent magnetic properties are required.

It could therefore be advantageous to provide a steel pipe with good magnetic properties that is suitable for use in a magnetic shield or a motor and a method of producing the same.

SUMMARY

We conducted intensive studies of various factors that affect magnetic properties of steel pipes. As a result, we found that the following are important to further improve the magnetic properties, in particular, soft magnetic properties of a steel pipe:

(a) The crystal structure is controlled so that the <100> direction of crystal grains is preferentially oriented parallel to the circumferential direction of the steel pipe, and the <011> direction of crystal grains is preferentially oriented parallel to the rolling direction of the steel pipe.

(b) The crystal grain size is relatively coarse, preferably 20 μm or more.

(c) The steel pipe does not include an electro-magnetically irregular area at an electric-resistance-welding area and so on.

In addition, we found that the following is preferable to further improve the magnetic properties.

(d) The carbon content is less than 0.01 mass percent.

Thus, we provide:

(1) A steel pipe with good magnetic properties including a composition containing about 0.5% or less C and about 85% or more Fe in terms of mass percent and a structure in which the ratio of X-ray diffraction intensity obtained from the plane in which the <100> direction of crystal grains is preferentially oriented parallel to the circumference direction and the <011> direction of crystal grains is preferentially oriented parallel to the rolling direction of the steel pipe to that obtained for a three-dimensionally randomly oriented sample is about 3.0 or more.

(2) The steel pipe according to item (1), wherein the r-value in the circumference direction is about 1.2 or more, and the r-value in the rolling direction is (the r-value in the circumference direction+1.0) or more.

(3) The steel pipe according to item (1) or (2), wherein the structure has an average crystal grain size of about 20 μm or more.

(4) The steel pipe according to any one of items (1) to (3), wherein the composition contains about 0.5% or less C, about 0.45% or less Si, about 0.1% to about 1.4% Mn, about 0.01% or less S, about 0.025% or less P, about 0.01% to about 0.06% Al, and about 0.005% or less N in terms of mass percent, the balance being Fe, and inevitable impurities.

(5) The steel pipe according to item (4), wherein the composition further contains at least one group selected from the following Groups A to C in terms of mass percent:

Group A: at least one selected from about 0.05% or less Ti, about 0.05% or less Nb, and about 0.005% or less B;

Group B: at least one selected from about 15% or less Cr, about 0.5% or less Ni, and about 0.3% or less Mo; and Group C: at least one of about 0.005% or less Ca and about 0.05% or less REM.

(6) A method of producing a steel pipe with good magnetic properties including heating a steel pipe having a composition containing about 0.5% or less C and about 85% or more Fe in terms of mass percent, and then performing stretch-reducing of the steel pipe, wherein the stretch-reducing is performed so that the diameter decrease ratio is about 15% or more and the rolling finishing temperature is (the $Ar_3$ transformation point−10)° C. or lower.

(7) The method of producing a steel pipe according to item (6), wherein the composition contains about 0.5% or less C, about 0.45% or less Si, about 0.1% to about 1.4% Mn, about 0.01% or less S, about 0.025% or less P, about 0.01% to about 0.06% Al, and about 0.005% or less N in terms of mass percent, the balance being Fe, and inevitable impurities.

(8) The method of producing a steel pipe according to item (7), wherein the composition further contains at least one group selected from the following Groups A to C in terms of mass percent:

Group A: at least one selected from about 0.05% or less Ti, about 0.05% or less Nb, and about 0.005% or less B;

Group B: at least one selected from about 15% or less Cr, about 0.5% or less Ni, and about 0.3% or less Mo; and Group C: at least one of about 0.005% or less Ca and about 0.05% or less REM.

(9) The method of producing a steel pipe according to any one of items (6) to (8), further including annealing at a temperature in the range of about 550° C. to the $Ac_1$ transformation point, the annealing being performed after the stretch-reducing or after the stretch-reduced pipe is further processed so as to have a desired shape.

(10) The method of producing a steel pipe according to item (9), further including cold drawing performed after the stretch-reducing and before the annealing.

(11) The method of producing a steel pipe according to any one of items (6) to (10), wherein the stretch-reducing is performed so that the thickness increase ratio is about 40% or less.

(12) The method of producing a steel pipe according to any one of items (6) to (10), wherein the stretch-reducing is performed so that the thickness decrease ratio is about 40% or less.

(13) A steel pipe with good magnetic properties including a composition containing less than about 0.01% C and about 95% or more Fe in terms of mass percent and a structure in which the ratio of X-ray diffraction intensity obtained from the plane in which the <100> direction of crystal grains is preferentially oriented parallel to the circumference direction and the <011> direction of crystal grains is preferentially oriented parallel to the rolling direction of the steel pipe to that obtained for a three-dimensionally randomly oriented sample is about 3.0 or more.

(14) The steel pipe according to item (13), wherein the r-value in the rolling direction is about 2.0 or more.

(15) The steel pipe according to item (13) or (14), wherein the structure has an average crystal grain size of about 20 μm or more.

(16) The steel pipe according to any one of items (13) to (15), wherein the composition contains less than about 0.01% C, about 0.45% or less Si, about 0.1% to about 1.4% Mn, about 0.01% or less S, about 0.025% or less P, about 0.01% to about 0.06% Al, and about 0.005% or less N in terms of mass percent, the balance being Fe, and inevitable impurities.

(17) The steel pipe according to any one of items (13) to (15), wherein the composition contains less than about 0.01% C, more than about 0.45% and about 3.5% or less Si, about 0.1% to about 1.4% Mn, about 0.01% or less S, about 0.025% or less P, more than about 0.06% and about 0.5% or less Al, and about 0.005% or less N in terms of mass percent, the balance being Fe, and inevitable impurities.

(18) The steel pipe according to item (16) or (17), wherein the composition further contains at least one group selected from the following Groups D to F in terms of mass percent:

Group D: at least one selected from about 0.05% or less Ti, about 0.05% or less Nb, and about 0.005% or less B;

Group E: at least one selected from about 5% or less Cr, about 5% or less Ni, and about 0.05% or less Mo; and Group F: at least one of about 0.005% or less Ca and about 0.05% or less REM.

(19) A method of producing a steel pipe with good magnetic properties including heating a steel pipe having a composition containing less than about 0.01% C and about 95% or more Fe in terms of mass percent, and then performing stretch-reducing of the steel pipe, wherein the stretch-reducing is performed so that the diameter decrease ratio is about 15% or more and the rolling finishing temperature is in the range of about 730° C. to about 900° C.

(20) The method of producing a steel pipe according to item (19), wherein the composition contains less than about 0.01% C, about 0.45% or less Si, about 0.1% to about 1.4% Mn, about 0.01% or less S, about 0.025% or less P, about 0.01% to about 0.06% Al, and about 0.005% or less N in terms of mass percent, the balance being Fe, and inevitable impurities.

(21) The method of producing a steel pipe according to item (19), wherein the composition contains less than about 0.01% C, more than about 0.45% and about 3.5% or less Si, about 0.1% to about 1.4% Mn, about 0.01% or less S, about 0.025% or less P, more than about 0.06% and about 0.5% or less Al, and about 0.005% or less N in terms of mass percent, the balance being Fe, and inevitable impurities.

(22) The method of producing a steel pipe according to item (20) or (21), wherein the composition further contains at least one group selected from the following Groups D to F in terms of mass percent:

Group D: at least one selected from about 0.05% or less Ti, about 0.05% or less Nb, and about 0.005% or less B;

Group E: at least one selected from about 5% or less Cr, about 5% or less Ni, and about 0.05% or less Mo; and Group F: at least one of about 0.005% or less Ca and about 0.05% or less REM.

(23) The method of producing a steel pipe according to any one of items (19) to (22), further including annealing at a temperature in the range of about 750° C. to the $Ac_1$ transformation point, the annealing being performed after the stretch-reducing or after the stretch-reduced pipe is further processed to have a desired shape.

(24) The method of producing a steel pipe according to item (23), further including cold drawing performed after the stretch-reducing and before the annealing.

(25) The method of producing a steel pipe according to any one of items (19) to (24), wherein the stretch-reducing is performed so that the thickness increase ratio is about 40% or less.

(26) The method of producing a steel pipe according to any one of items (19) to (24), wherein the stretch-reducing is performed so that the thickness decrease ratio is about 40% or less.

DETAILED DESCRIPTION

A steel pipe of the present invention has a composition containing 0.5% or less of carbon (C) and 85% or more of iron (Fe) in terms of mass percent. First, a description will be made of the reason for the characterization of the composition of the steel pipe. Hereinafter, the term "mass percent" in a composition is simply expressed as "%".

C: 0.5% or Less

Carbon (C) is an element that increases the strength of the steel, and a predetermined amount of C is preferably contained in accordance with the desired strength of the steel pipe. However, when the C content exceeds 0.5%, the growth of crystal grains is degraded. Therefore, the C content is limited to 0.5% or less. Since C degrades magnetic properties of the steel pipe, the C content is preferably minimized in view of the magnetic properties. Considering the degradation with the lapse of time due to magnetic aging, the C content is preferably 0.01% or less, and more preferably less than 0.01% from the standpoint of further improving the magnetic properties. When the C content is 0.01% or more, the content of a metal element added for fixing C as a precipitation (carbide-forming element) is increased, and the magnetic properties of the steel pipe are not easily improved in some cases. More preferably, the C content is 0.004% or less. However, when the C content is decreased to 0.001% or less, the refining time is excessively prolonged, resulting in an increase in the refining cost. Accordingly, the lower limit of the C content is preferably about 0.001% from the economical standpoint.

Fe: 85% or More

As the content of impurities increases, factors inhibiting the growth of crystal grains are increased, thereby degrading the magnetic properties of the steel pipe. Therefore, a high-purity steel with a small impurity content is preferred. From the standpoint that the content of impurities is controlled to increase the purity, the Fe content is 85% or more, preferably 95% or more, and more preferably 98% or more.

The basic composition is the composition described above. To further improve the magnetic properties of the steel pipe, the composition preferably contains 0.5% or less of C, 0.45% or less of Si, 0.1% to 1.4% of Mn, 0.01% or less of S, 0.025% or less of P, 0.01% to 0.06% of Al, and 0.005% or less of N in terms of mass percent, the balance being Fe, and inevitable impurities.

For applications that require further improvement in the magnetic properties of the steel pipe, a high-purity composition in which the C content is less than 0.01%, the content of other elements is minimized, and the Fe content is 95% or more is preferred. According to need, Si and Al may be contained to further improve the magnetic properties, and Cr, Ni, and the like may be contained in order to further improve the magnetic properties in the high-frequency range. For applications that require such excellent magnetic properties of the steel pipe, a high-purity composition containing less than 0.01% of C, 0.45% or less of Si, 0.1% to 1.4% of Mn, 0.01% or less of S, 0.025% or less of P, 0.01% to 0.06% of Al, and 0.005% or less of N in terms of mass percent, the balance being Fe, and inevitable impurities or a high-purity composition containing less than 0.01% of C, more than 0.45% and 3.5% or less of Si, 0.1% to 1.4% of Mn, 0.01% or less of S, 0.025% or less of P, more than 0.06% and 0.5% or less of Al, and 0.005% or less of N in terms of mass percent, the balance being Fe, and inevitable impurities is preferred.

Si: 0.45% or Less, or More than 0.45% and 3.5% or Less

Silicon (Si) acts as a deoxidizer and is contained in an amount of at least 0.01%. Silicon is an element that improves the magnetic properties of the steel pipe, in particular, the core loss property and that increases the strength of the steel pipe by a solid solution. However, a content exceeding 0.45% tends to decrease the electric resistance weldability. Therefore, the Si content is preferably limited to 0.45% or less. When particularly good magnetic properties of the steel pipe are required, the Si content can be more than 0.45% and 3.5% or less. When the Si content exceeds about 3.5%, the magnetic flux density (B) in a low H (magnetic field) region is excellent, but the saturation magnetic flux density B in a high H region is decreased, and furthermore, the electric resistance weldability is significantly degraded.

Mn: 0.1% to 1.4%

Manganese (Mn) is an element that is combined with sulfur (S) to produce MnS and eliminates the adverse effect of S. Thus, Mn improves hot workability. The Mn content is preferably determined in accordance with the S content. Mn is preferably contained in an amount of 0.1% or more. Manganese is an element that increases the strength of the steel pipe by forming a solid solution, and the Mn content is preferably determined in accordance with a desired strength of the steel pipe. However, a content exceeding 1.4% degrades the toughness. Therefore, the Mn content is preferably limited in the range of 0.1% to 1.4%, and more preferably in the range of 0.3% to 0.6%.

S: 0.01% or Less

Sulfur (S) is present as an inclusion in the steel, thereby degrading workability, and degrades the magnetic properties of the steel pipe in the form of MnS. Therefore, the S content is preferably minimized. Accordingly, the S content is preferably limited to 0.01% or less. When large amounts of Si and Al are contained to improve the magnetic properties of the steel pipe, the S content is preferably decreased to 0.001% or less to improve the punchability. However, since an excessive decrease in the S content results in a significant increase in the refining cost, the lower limit of the S content is about 0.001%.

P: 0.025% or Less

Phosphorus (P) is an element that contributes to an increase in the strength of the steel pipe and improves the magnetic properties thereof by forming a solid solution. However, P tends to be segregated in grain boundaries, and may cause an adverse effect of blocking the motion of magnetic domain walls. Therefore, the P content is preferably limited to 0.025% or less. However, since an excessive decrease in the P content results in a significant increase in the refining cost, the lower limit of the P content is about 0.005%.

Al: 0.01% to 0.06%, or More than 0.06% and 0.5% or Less

Aluminum (Al) is an element that acts as a deoxidizer and decreases the amount of nitrogen (N) contained as a solid solution by forming AlN. This effect can be achieved in a content of 0.01% or more. However, when the Al content exceeds 0.06%, the amount of inclusions is increased and the magnetic properties of the steel pipe are often degraded depending on the N contents. Therefore, the Al content is preferably limited in the range of 0.01% to 0.06%. More preferably, the Al content is in the range of 27/14N to 3×27/14N wherein N represents the N content. When the steel contains powerful nitride-forming elements such as Ti and B, the Al content may be small. Aluminum is an element that improves the magnetic properties of the steel pipe together with Si. In particular, when good magnetic properties of the steel pipe in a low H (magnetic field) region are required, the Al content can be more than 0.06% and 0.5% or less. However, an Al content exceeding 0.5% may degrade the magnetic properties of the steel pipe instead.

N: 0.005% or Less

Nitrogen (N) increases the strength of the steel as an interstitial solid solution element, but increases the internal stress and degrades the magnetic properties thereof. Furthermore, N forms AlN and adversely affects the magnetic properties of the steel pipe. Therefore, the N content is preferably minimized, but a content of 0.005% or less is acceptable. Accordingly, the N content is preferably limited to 0.005% or less. In view of the refining cost, the lower limit of the N content is about 0.001%. When a large amount of Al is contained in order to improve the magnetic properties of the steel pipe, the N content is preferably decreased to 0.0025% or less so as not to cause the degradation of magnetic properties of the steel pipe due to AlN.

In addition to the above-described components, at least one group selected from the following Groups A to C may be contained:

- Group A: at least one selected from 0.05% or less Ti, 0.05% or less Nb, and 0.005% or less B;
- Group B: at least one selected from 15% or less Cr, 0.5% or less Ni, and 0.3% or less Mo; and
- Group C: at least one of 0.005% or less Ca and 0.05% or less a rare earth metal (REM).

In the case of the high-purity composition, at least one group selected from the following Groups D to F is preferably contained:

- Group D: at least one selected from 0.05% or less Ti, 0.05% or less Nb, and 0.005% or less B;
- Group E: at least one selected from 5% or less Cr, 5% or less Ni, and 0.05% or less Mo; and
- Group F: at least one of 0.005% or less Ca and 0.05% or less REM.

Titanium (Ti), niobium (Nb), and boron (B) in Group A or Group D are elements that form a carbide, a nitride, or the like to increase the strength of the steel pipe, and can be selected and contained according to need. A Ti content exceeding 0.05%, a Nb content exceeding 0.05%, and a B content exceeding 0.005% often degrade the magnetic properties of the steel pipe. Therefore, preferably, the upper limit of the Ti content is 0.05%, the upper limit of the Nb content is 0.05%, and the upper limit of the B content is 0.005%.

Group B or Group E: Chromium (Cr), molybdenum (Mo), and nickel (Ni) are elements that improve hardenability and corrosion resistance, and can be selected and contained according to need. A Cr content exceeding 15%, a Mo content exceeding 0.3%, and a Ni content exceeding 0.5% degrade the magnetic properties of the steel pipe. Therefore, preferably, the upper limit of the Cr content is 15%, the upper limit of the Mo content is 0.3%, and the upper limit of the Ni content is 0.5%. Chromium is an element that particularly improves corrosion resistance. A large content up to 15% of Cr is limited to the case where corrosion resistance must be markedly improved. When Cr is contained for the purpose of improving hardenability, the Cr content is preferably 0.05% or less. For applications that require further improvement in the magnetic properties of the steel pipe, preferably, the Cr content is 0.05% or less, the Mo content is 0.05% or less, and the Ni content is 0.05% or less. When the magnetic properties of the steel pipe in the high-frequency range are required to be further increased, 5% or less of Cr, 5% or less of Ni, and 0.05% or less of Mo can be contained under the condition of the high-purity composition containing 95% or more of Fe.

Group C or Group F: Calcium (Ca) and REM are elements that control the form of inclusions and improve corrosion resistance, and can be selected and contained according to need. When the steel is used in an environment where the steel is in contact with even a small amount of water, Ca or REM are preferably contained, thereby improving corrosion resistance. A Ca content exceeding 0.005% and an REM content exceeding 0.05% degrade the magnetic properties of the steel pipe. Therefore, preferably, the upper limit of the Ca content is 0.005%, and the upper limit of the REM content is 0.05%.

The balance other than the above components includes Fe and inevitable impurities.

In addition to the above-described composition, the steel pipe has a structure in which the ratio of X-ray diffraction intensity obtained from the plane in which the <100> direction of crystal grains is preferentially oriented parallel to the circumference direction and the <011> direction of crystal grains is preferentially oriented parallel to the rolling direction of the steel pipe to that obtained for a three-dimensionally randomly oriented sample (e.g., electric-resistance-welded (ERW) pipe produced from a hot-rolled steel sheet) (hereinafter also referred to as "X-ray intensity ratio relative to a three-dimensionally randomly oriented sample") is 3.0 or more.

The crystal orientation is controlled so that the <100> direction of crystal grains, which is the axis of easy magnetization, is preferentially oriented parallel to the circumferential direction of the steel pipe, and the <011> direction of crystal grains is preferentially oriented parallel to the rolling direction of the steel pipe. Accordingly, the magnetic properties of the steel pipe are markedly improved. The ratio of X-ray diffraction intensity obtained from the plane in which the <100> direction of crystal grains is preferentially oriented parallel to the circumference direction and the <011> direction of crystal grains is preferentially oriented parallel to the rolling direction of the steel pipe to that obtained for a three-dimensionally randomly oriented sample is 3.0 or more. When the X-ray diffraction intensity ratio relative to the three-dimensionally randomly oriented sample is less than 3.0, good magnetic properties of the steel pipe cannot be obtained. The ratio is preferably about 8.0 or more, and more preferably about 10 or more.

Herein, the term "X-ray intensity ratio relative to a three-dimensionally randomly oriented sample" is an index representing the presence or absence of a certain specific crystal orientation. The X-ray diffraction intensity of a certain specific crystal orientation of a non-oriented standard material (randomly oriented sample) is defined as 1, and the X-ray diffraction intensity of the specific crystal orientation of a sample is normalized by the X-ray diffraction intensity of the randomly orientated material. A larger ratio means a stronger orientation.

More specifically, the ratio is determined as follows. An incomplete pole figure is measured by a reflection method, and the integrated intensity of a specified crystal orientation (in the present invention, the crystal orientation in which the <100> direction of crystal grains is preferentially oriented parallel to the circumferential direction, and the <011> direction of crystal grains is preferentially oriented parallel to the rolling direction) is normalized by the intensity of the randomly oriented sample. A complete pole figure measured by both the reflection method and the transmission method also provides the same value.

For the purpose of this description, the term "good magnetic properties" means that the maximum relative permeability of the steel pipe is higher than that of a steel pipe as being electric-resistance-welded, which is not subjected to the subsequent process, and that the magnetic flux density of the steel pipe is higher than that of the steel pipe as being electric-resistance-welded under a low magnetic field condition with a magnetizing force of 200 A/m. However, the maximum relative permeability and the magnetic flux density at 200 A/m of the steel pipe as being electric-resistance-welded are affected by the chemical composition. Therefore, it should be considered that a high-purity composition provides better magnetic properties. Accordingly, for example, when the magnetic properties of a steel pipe having a composition containing a large amount of additional elements are better than those of a high-purity steel pipe as being electric-resistance-welded, even if the differences are small, it can be considered that the magnetic properties of the former steel pipe are markedly improved.

In the steel pipe having the high-purity composition, the term "good magnetic properties" means that the maximum relative permeability of the steel pipe is preferably 2,500 or more, and more preferably 7,500 or more, and that the magnetic flux density of the steel pipe under a low magnetic field condition with a magnetizing force of 200 A/m is 0.8 T or more, and more preferably 1.0 T or more. In addition, the criterion of "good magnetic properties" is determined on the basis of the following comparisons. To evaluate a steel pipe as being stretch-reduced, the maximum relative permeability and the magnetic flux density of the steel pipe are compared with those of a steel pipe as being electric-resistance-welded. To evaluate a steel pipe produced by stretch-reducing a steel pipe and then heat-treating the pipe, the maximum relative permeability and the magnetic flux density of the steel pipe are compared with those of a steel pipe produced by heat-treating a steel pipe as being electric-resistance-welded.

Furthermore, the steel pipe preferably has a structure having an average crystal grain size of 5 μm or more. In an average crystal grain size of less than 5 μm, even when the <100> direction of crystal grains is preferentially oriented parallel to the circumferential direction and the <011> direction of crystal grains is preferentially oriented parallel to the rolling direction of the steel pipe, good magnetic properties cannot be ensured. From the standpoint that good magnetic properties can be obtained, preferably, the crystal grains are relatively coarse grains. The average crystal grain size is more preferably 10 μm or more, still more preferably 20 μm or more, and most preferably 40 μm or more. In particular, when the average crystal grain size is 20 μm or more, and furthermore 40 μm or more, a steel pipe having excellent magnetic properties can be provided.

The steel pipe preferably has an r-value (plastic strain ratio) in the circumferential direction of 1.2 or more and an r-value in the rolling direction of (the r-value in the circumference direction+1.0) or more. The steel pipe having a high-purity composition preferably has an r-value in the rolling direction of about 2.0 or more. When the steel pipe has an r-value in the circumferential direction of 1.2 or more and an r-value in the rolling direction of (the r-value in the circumference direction+1.0) or more or when the steel pipe having a high-purity composition has an r-value in the rolling direction of 2.0 or more, good magnetic properties can be ensured. When the r-values are less than the above values, it is difficult to ensure good magnetic properties. In the steel pipe having a high-purity composition, the r-value in the rolling direction is preferably about 4.0 or more, and more preferably about 8.0 or more.

The r-value is generally used as an index of formability. The steel pipe has a crystal orientation in which the <100> direction of crystal grains is preferentially oriented parallel to the circumferential direction, and the <011> direction of crystal grains is preferentially oriented parallel to the rolling direction of the steel pipe. Accordingly, the r-value in the rolling direction is suitably associated with magnetic properties in conjunction with an improvement in the magnetic properties. Therefore, in the steel pipe, the r-value can be used as an index of magnetic properties.

The r-value is calculated as follows. Strain gauges are applied on a test piece in the tensile direction and in the direction perpendicular to the tensile direction, and a tensile test is performed using the test piece. The displacement in each direction is sequentially measured. The r-value is calculated from the displacement at an elongation in the range of about 6% to 7%. The reason the r-value is calculated at an elongation in the range of 6% to 7% is that the r-value is calculated in the plastic deformation region exceeding the region of yield point elongation. The r-value is calculated using the following equation:

$$r\text{-value}=-1/\{1+\ln(L_0/L)/\ln(W_0/W)\}$$

wherein L represents the length of a test piece in the tensile direction, $L_0$ represents the initial length of the test piece in the tensile direction, W represents the length of the test piece in the width direction, and $W_0$ represents the initial length of the test piece in the width direction. When the yield point elongation exceeds 7%, the r-value is measured at a part that is subjected to plastic deformation. The r-values may be evaluated using a JIS No. 12 test piece (arcuate test piece) or a flat plate test piece prepared by expanding a steel pipe to a flat plate. The test piece may be a JIS No. 5 test piece, a No. 13B test piece, or the like and is not particularly limited as long as areas on which strain gauges are applied can be provided on parallel parts of the test piece. However, in the measurement of the r-value in the circumference direction, the test piece must be prepared by expanding a steel pipe to a flat plate.

Next, a preferred method of producing a steel pipe will be described.

The steel pipe having the above-described composition is heated to perform stretch-reducing.

The method of producing the steel pipe is not particularly limited as long as the steel pipe has the above composition. A seamless steel pipe produced by a known method or a welded steel pipe such as an electric-resistance-welded steel pipe (ERW steel pipe) produced by a known method can be suitably used.

In the stretch-reducing, the method of heating the steel pipe is not particularly limited. Any heating method such as heating with a heating furnace or induction heating can be employed. Regarding a steel pipe produced by a hot working, for example a seamless steel pipe, after the formation of the pipe, the steel pipe can be directly transferred to a stretch-reducing apparatus to perform stretch-reducing. Alternatively, the steel pipe may be reheated and then stretch-reduced.

When the steel pipe is reheated, the heating temperature during stretch-reducing is preferably 1,100° C. or lower. When the heating temperature exceeds 1,100° C., the surface characteristic of the steel pipe is degraded. However, when polishing, etching, or the like is performed after the stretch-reducing, the upper limit of the heating temperature need not be limited. The heating temperature is preferably 700° C. or higher. When the steel pipe having a high-purity composition is used, the heating temperature is preferably 750° C. or higher. When the heating temperature is lower than 700° C. or when the heating temperature is lower than 750° C. in the case where the steel pipe having a high-purity composition is used, the deformation resistance is increased and thus it is difficult to ensure a predetermined diameter decrease ratio or more, and strain due to the stretch-reducing remains in the steel pipe after cooling, thereby degrading the magnetic properties. In a steel pipe having a welding area, such as an electric-resistance-welded steel pipe, the heating temperature is preferably the $Ac_3$ transformation point or higher from the standpoint that the irregular area is removed and magnetic properties of the whole steel pipe are improved. The above lower limits of the heating temperature are necessary in order to ensure a predetermined rolling finishing temperature of the stretch-reducing or a higher temperature.

In the stretch-reducing, the diameter decrease ratio is preferably 15% or more and the rolling finishing temperature is preferably (the $Ar_3$ transformation point−10)° C. or lower. In the stretch-reducing of the steel pipe having a high-purity composition, the diameter decrease ratio is preferably 15% or more and the rolling finishing temperature is preferably in the range of 730° C. to 900° C. Accordingly, the structure of the steel pipe has a crystal orientation in which the <100> direction of crystal grains is preferentially oriented parallel to the circumferential direction, and the <011> direction of crystal grains is preferentially oriented parallel to the rolling direction and has relatively coarse crystals whose grains are grown.

When the diameter decrease ratio is less than 15%, the amount of decrease in diameter is insufficient, and the crystals are not easily oriented in the above desired crystal directions. The upper limit of the diameter decrease ratio depends on the dimensions of product and the capacity of a rolling machine and is not particularly limited. However, the upper limit of the diameter decrease ratio is preferably in the range of about 85% to 90%. More preferably, the diameter decrease ratio is in the range of 45% to 80%.

The rolling finishing temperature of the stretch-reducing is preferably (the $Ar_3$ transformation point−10)° C. or lower. In the steel pipe having a high-purity composition, the rolling finishing temperature is preferably 900° C. or lower. When the rolling finishing temperature of the stretch-reducing is higher than (the $Ar_3$ transformation point−10)° C. (900° C. in the case of the steel pipe having a high-purity composition), the stretch-reducing is finished in the austenitic region. In this case, the crystals are oriented not in the above desired directions but in random directions. Consequently, the magnetic properties are not improved. Herein, the rolling finishing temperature represents a temperature measured on the surface of the steel pipe. The rolling finishing temperature is preferably 400° C. or higher (730° C. or higher in the case of the steel pipe having a high-purity composition). When the rolling finishing temperature is lower than 400° C. (lower than 730° C. in the case of the steel pipe having a high-purity composition), strain due to the stretch-reducing remains and it is difficult to obtain the crystal orientation in which the <100> direction of crystal grains is preferentially oriented parallel to the circumferential direction, and the <011> direction of crystal grains is preferentially oriented parallel to the rolling direction, thereby degrading the magnetic properties. More preferably, the rolling finishing temperature is 600° C. or higher (750° C. or higher in the case of the steel pipe having a pure iron-based composition).

The stretch-reducing is more preferably performed so that the thickness decrease ratio is 40% or less or the thickness increase ratio is 40% or less. When the thickness decrease ratio or the thickness increase ratio exceeds 40%, the crystal orientation is excessively rotated, which affects the crystal orientation. Accordingly, the above desired crystal orientation cannot be obtained. Therefore, the thickness decrease ratio of the stretch-reducing is preferably limited to 40% or less or the thickness increase ratio of the stretch-reducing is preferably limited to 40% or less. When a steel pipe as being stretch-reduced is used, the thickness increase ratio is more preferably in the range of 10% to 25%. On the other hand, when annealing is performed after the stretch-reducing, the thickness decrease ratio is more preferably in the range of 10% to 25%. By limiting the thickness increase ratio or the thickness decrease ratio to the above ranges, the <100> direction of crystal grains is further preferentially oriented parallel to the circumferential direction, thus further improving the magnetic properties.

The thickness decrease ratio or the thickness increase ratio, that is, the ratio of change in thickness is calculated by the following equation:

$$\text{Ratio of change in thickness}=[\{(\text{thickness after stretch-reducing})-(\text{thickness of original pipe})\}/(\text{thickness of original pipe}]\times 100(\%).$$

After the stretch-reducing, or after the stretch-reduced pipe is further processed to have a desired shape, annealing is preferably performed at a temperature in the range of 550° C. to the $Ac_1$ transformation point. In the steel pipe having a high-purity composition, the annealing temperature is preferably in the range of 750° C. to the $Ac_1$ transformation point.

When annealing is performed at a temperature in the range of 550° C. to the $Ac_1$ transformation point, or when annealing is performed at a temperature in the range of 750° C. to the $Ac_1$ transformation point in the steel pipe having a high-purity composition, crystal grains are further grown, thereby further improving the magnetic properties. When the annealing temperature is lower than 550° C. (lower than 750° C. in the case of the steel pipe having a high-purity composition), crystal grains are grown slowly and it takes a long time to grow the crystal grains to a desired grain size. On the other hand, when the annealing temperature exceeds the $Ac_1$ transformation point, the crystal orientation begins to disorder. Therefore, annealing is performed at a temperature in the range of 550° C. to the $Ac_1$ transformation point (in the range of 750° C. to the $Ac_1$ transformation point in the case of the steel pipe having a high-purity composition).

In view of the magnetic properties, the cooling after annealing is preferably slow cooling. Annealing may be performed either after the stretch-reducing or after the stretch-reduced pipe is further processed so as to have a desired shape. In both cases, the same effect can be obtained. By optimizing the conditions for annealing, the average crystal grain size can be easily controlled to be 20 μm or more, and preferably 40 μm or more.

Furthermore, cold drawing is preferably performed after the stretch-reducing and before the annealing. In this case, a steel pipe having excellent magnetic properties can be produced. The reason for this is as follows. Since cold strain is applied to the steel pipe by the cold drawing while the rotation of crystal grains is restricted to some degree, the orientation of the crystal grains and growth of the grains are promoted during annealing. In the cold drawing, the area decrease ratio is preferably in the range of 15% to 60%. The area decrease ratio is calculated by the following equation:

Area decrease ratio(%)={(cross-sectional area of steel pipe before drawing)−(cross-sectional area of steel pipe after drawing)}/(cross-sectional area of steel pipe before drawing)×100.

EXAMPLES

Example 1

Thin steel strips having the compositions shown in Table 1 were roll-formed to prepare open pipes, and the ends of the open pipes were joined by electric resistance welding to prepare electric-resistance-welded steel pipes. Cast slabs having the compositions shown in Table 1 were formed into pipes by the Mannesmann process to prepare seamless steel pipes. These electric-resistance-welded steel pipes and seamless steel pipes were used as steel pipe blanks.

The steel pipe blanks were heated to 900° C. to 1,000° C., and then stretch-reduced under the conditions (diameter decrease ratio, thickness decrease (−) ratio/thickness increase (+) ratio, and rolling finishing temperature) shown in Table 2. Some of the prepared steel pipes were then cold-drawn and/or annealed. In the cold drawing, the area decrease ratio was 30%. The annealing was performed at a temperature in the range of 500° C. to 900° C.

The measurement of magnetic properties, the examination of structures, and the measurement of the r-value were performed using the prepared steel pipes. The measurement methods were as follows.

(1) Magnetic Properties

Each of the prepared steel pipes was cut into a ring having a length in the range of 5 to 10 mm, and the cut surface was polished. The number of primary windings was 250 and the number of secondary windings was 100. The direct current magnetization characteristics of the samples were measured. The permeability was measured while applying a magnetizing force up to 10,000 A/m. The maximum (maximum permeability) was determined to calculate the maximum relative permeability. Furthermore, the magnetic flux density at a magnetizing force of 200 A/m was determined. The measurement was performed after scales were removed by acid washing. The maximum relative permeability was evaluated by the following maximum relative permeability ratio. The maximum relative permeability of a standard steel pipe as being electric-resistance-welded (steel pipe No. 1), which was not subjected to the subsequent process, was defined as a standard (1.0). The ratio of the maximum relative permeability of a steel pipe to the maximum relative permeability of the standard steel pipe was defined as the maximum relative permeability ratio.

(2) Examination of Structure

The crystal grain size and the crystal orientation of each of the prepared steel pipes were measured.

A cross section of each steel pipe in the L-direction was etched with an etchant (nital), and the structure observed with a microscope. The crystal grain size was calculated by the crossed straight line segment method. The measurement position was the center of the wall in the thickness direction, i.e., the part other than the surface layers disposed within 100 μm from the surfaces. The total length of line segments of 500 crystal grains was measured along the L-direction, and the total length of line segments of 500 crystal grains similarly measured along the direction of the wall thickness. Grain sizes were calculated by dividing the length of the line segments in each direction by the number of ferrite grains. The grain sizes were averaged, and the average was defined as the average crystal grain size.

The crystal orientation was determined by measuring the X-ray intensity ratio relative to a three-dimensionally randomly oriented sample by X-ray diffractometry. A flat steel plate was prepared by expanding each steel pipe. Subsequently, 500 μm or more of each surface layer of the steel plate was removed by polishing. Thus, a test piece having a mirror-finished surface was prepared from substantially the center of the wall thickness of the steel pipe. Furthermore, the test piece was subjected to chemical polishing (etchant: 2% to 3% hydrofluoric acid and aqueous hydrogen peroxide) to remove working strain due to the polishing.

An incomplete pole figure of the prepared test piece was obtained by a reflection method with an X-ray diffractometer. The integrated intensity of the crystal orientation in which the <100> direction of crystal grains was preferentially oriented parallel to the circumferential direction of the steel pipe, and the <011> direction of crystal grains was preferentially oriented parallel to the rolling direction thereof was normalized by the intensity of the randomly oriented sample on the basis of the results. Thus, the X-ray intensity ratio relative to the three-dimensionally randomly oriented sample was determined. The X-ray source used was CuKα.

(3) Measurement of r-Value

The r-value was evaluated using test pieces prepared by expanding each steel pipe to a flat plate or test pieces (JIS No. 12 test pieces) prepared by cutting out from each steel pipe. The method of measuring the r-value was the same as the method described above.

The results are shown in Table 2.

TABLE 1

| Steel | Chemical components (mass %) | | | | | | | | |
|---|---|---|---|---|---|---|---|---|---|
| No. | C | Si | Mn | P | S | Al | N | Others | Fe |
| A | 0.045 | 0.02 | 0.36 | 0.017 | 0.007 | 0.048 | 0.0031 | — | 99.5(Bal.) |
| B | 0.0018 | 0.01 | 0.18 | 0.012 | 0.005 | 0.048 | 0.0021 | Ti: 0.07, Nb: 0.03, B: 0.0011 | 99.6 |
| C | 0.008 | 0.40 | 0.30 | 0.018 | 0.005 | 0.052 | 0.0051 | Cr: 11, Ni: 0.1, Ti: 0.25 | 87.9 |
| D | 0.041 | 0.01 | 0.32 | 0.010 | 0.009 | 0.055 | 0.0028 | — | 99.6 |
| E | 0.18 | 0.18 | 0.81 | 0.016 | 0.008 | 0.041 | 0.0035 | Ca: 0.0040 | 98.8 |
| F | 0.45 | 0.25 | 1.32 | 0.019 | 0.004 | 0.045 | 0.0033 | — | 97.9 |
| G | 0.97 | 0.19 | 1.40 | 0.018 | 0.008 | 0.041 | 0.0035 | — | 97.4 |
| H | 0.042 | 0.02 | 0.33 | 0.019 | 0.008 | 0.038 | 0.0032 | — | 99.5 |
| I | 0.041 | 0.01 | 0.35 | 0.014 | 0.008 | 0.045 | 0.0034 | — | 99.5 |
| J | 0.043 | 0.02 | 0.32 | 0.018 | 0.007 | 0.040 | 0.0029 | — | 99.5 |
| K | 0.040 | 0.01 | 0.33 | 0.020 | 0.009 | 0.035 | 0.0035 | — | 99.6 |
| L | 0.049 | 0.01 | 0.37 | 0.014 | 0.008 | 0.038 | 0.0033 | — | 99.5 |
| M | 0.045 | 0.02 | 0.33 | 0.019 | 0.008 | 0.045 | 0.0038 | — | 99.5 |

TABLE 1-continued

| Steel | Chemical components (mass %) | | | | | | | | |
|---|---|---|---|---|---|---|---|---|---|
| No. | C | Si | Mn | P | S | Al | N | Others | Fe |
| N | 0.044 | 0.01 | 0.35 | 0.018 | 0.007 | 0.045 | 0.0032 | REM: 0.01 | 99.5 |
| O | 0.047 | 0.02 | 0.34 | 0.016 | 0.007 | 0.047 | 0.0035 | REM: 0.01 | 99.5 |
| P | 0.042 | 0.01 | 0.32 | 0.010 | 0.007 | 0.049 | 0.0038 | — | 99.6 |
| Q | 0.043 | 0.01 | 0.36 | 0.012 | 0.008 | 0.051 | 0.0031 | — | 99.5 |
| R | 0.08 | 0.15 | 0.33 | 0.010 | 0.007 | 0.047 | 0.0029 | — | 99.4 |
| S | 0.09 | 0.10 | 0.35 | 0.015 | 0.008 | 0.045 | 0.0035 | Ca: 0.0015 | 99.4 |
| T | 0.09 | 0.10 | 0.35 | 0.015 | 0.008 | 0.045 | 0.0035 | Ca: 0.0018 | 99.4 |
| U | 0.11 | 0.15 | 0.39 | 0.017 | 0.007 | 0.047 | 0.0030 | Ca: 0.0025 | 99.3 |
| V | 0.10 | 0.13 | 0.41 | 0.010 | 0.008 | 0.050 | 0.0033 | Ca: 0.0027 | 99.3 |
| W | 0.10 | 0.13 | 0.41 | 0.010 | 0.008 | 0.050 | 0.0033 | Ca: 0.0024 | 99.3 |
| X | 0.09 | 0.19 | 0.32 | 0.009 | 0.009 | 0.047 | 0.0040 | Ca: 0.0017 | 99.3 |
| Y | 0.20 | 0.25 | 1.28 | 0.012 | 0.001 | 0.029 | 0.0027 | Cr: 0.15, Mo: 0.09, Ti: 0.01, Nb: 0.01, B: 0.001 | 97.8 |

TABLE 2

| Steel pipe No. | Steel sheet No. | $Ar_3$ ° C. | $Ac_1$ ° C. | Steel pipe blank Type | Stretch-reducing: Diameter decrease ratio % | Stretch-reducing: Rolling finishing temperature ° C. | Stretch-reducing: Ratio of change in thickness % | Cold drawing ratio % | Annealing temperature ° C. |
|---|---|---|---|---|---|---|---|---|---|
| 1 | A | 860 | 730 | ERW steel pipe | — | — | — | — | — |
| 2 | B | 905 | **** | ERW steel pipe | 65 | 760 | ≦±3 | — | — |
| 3 | C | 800 | 750 | ERW steel pipe | 70 | 720 | ≦±3 | — | — |
| 4 | D | 860 | 730 | ERW steel pipe | 64 | 750 | ≦±3 | — | — |
| 5 | E | 820 | 730 | ERW steel pipe | 69 | 610 | ≦±3 | — | — |
| 6 | F | 765 | 720 | Seamless steel pipe | 71 | 710 | ≦±3 | — | — |
| 7 | G | 810 | 720 | ERW steel pipe | 58 | 700 | ≦±3 | — | — |
| 8 | H | 860 | 730 | Seamless steel pipe | 55 | 750 | ≦±3 | — | — |
| 9 | I | 860 | 730 | ERW steel pipe | 15 | 750 | ≦±3 | — | — |
| 10 | J | 860 | 730 | ERW steel pipe | 5 | 750 | ≦±3 | — | — |
| 11 | K | 860 | 730 | ERW steel pipe | 75 | 830 | ≦±3 | — | — |
| 12 | L | 860 | 730 | ERW steel pipe | 75 | 880 | ≦±3 | — | — |
| 13 | M | 860 | 730 | ERW steel pipe | 65 | 720 | ≦±3 | 30 | 750 |
| 14 | N | 860 | 730 | ERW steel pipe | 75 | 750 | ≦±3 | — | 500 |
| 15 | O | 860 | 730 | ERW steel pipe | 75 | 750 | ≦±3 | — | 600 |
| 16 | P | 860 | 730 | ERW steel pipe | 61 | 750 | ≦±3 | — | 700 |
| 17 | Q | 860 | 730 | ERW steel pipe | 75 | 750 | ≦±3 | — | 800 |
| 18 | R | 840 | 730 | ERW steel pipe | 75 | 750 | ≦±3 | — | 900 |
| 19 | S | 840 | 730 | ERW steel pipe | 67 | 700 | −10.3 | — | 700 |
| 20 | T | 840 | 730 | ERW steel pipe | 67 | 710 | −24.8 | — | 700 |
| 21 | U | 840 | 730 | ERW steel pipe | 67 | 715 | −40.0 | — | 700 |
| 22 | V | 840 | 730 | ERW steel pipe | 67 | 760 | +10.2 | — | — |
| 23 | W | 840 | 730 | ERW steel pipe | 67 | 750 | +25.0 | — | — |
| 24 | X | 840 | 730 | ERW steel pipe | 67 | 715 | +49.8 | — | — |
| 25 | Y | 815 | 720 | ERW steel pipe | 75 | 690 | ≦±3 | — | 750 |

| Steel pipe No. | Structure: Intensity ratio relative to three-dimensionally randomly oriented sample* | Structure: Average crystal grain size μm | r-value: Circumference direction | r-value: Rolling direction | Magnetic properties: Maximum relative permeability ratio***** | Magnetic properties: Magnetic Flux density*** T | Remarks |
|---|---|---|---|---|---|---|---|
| 1 | 1.1 | 18 | 0.8 | 1.2 | 1.0 (Standard) | 0.48 | Comparative Example |
| 2 | 7.6 | 20 | — | 6.5** | 1.2 | 0.78 | Example |
| 3 | 3.4 | 13 | — | 2.2** | 1.1 | 0.54 | Example |
| 4 | 8.7 | 8 | 1.9 | — | 1.1 | 0.60 | Example |
| 5 | 4.3 | 7 | | 3.2** | 1.0 | 0.53 | Example |
| 6 | 3.6 | 5 | — | — | 1.0 | 0.52 | Example |
| 7 | 3.1 | 5 | — | — | 0.8 | 0.39 | Comparative Example |
| 8 | 7.6 | 10 | 1.7 | 3.1 | 1.1 | 0.62 | Example |
| 9 | 4.0 | 15 | 1.4 | 2.3 | 1.1 | 0.55 | Example |
| 10 | 1.2 | 18 | 0.8 | 1.3 | 1.0 | 0.47 | Comparative Example |
| 11 | 9.2 | 16 | 1.7 | 3.7 | 1.9 | 0.70 | Example |

TABLE 2-continued

| | | | | | | | |
|---|---|---|---|---|---|---|---|
| 12 | 1.1 | 25 | 1.0 | 1.2 | 1.0 | 0.51 | Comparative Example |
| 13 | 10.7 | 38 | 2.1 | 5.3 | 3.4 | 1.49 | Example |
| 14 | 8.3 | 8 | 1.9 | 3.4 | 1.1 | 0.62 | Example |
| 15 | 9.0 | 9 | 2.0 | 4.2 | 1.4 | 1.08 | Example |
| 16 | 10.5 | 24 | 2.0 | 4.4 | 2.6 | 1.35 | Example |
| 17 | 1.4 | 28 | 1.0 | 1.4 | 1.3 | 0.51 | Comparative Example |
| 18 | 1.3 | 25 | 0.9 | 1.3 | 1.4 | 0.52 | Comparative Example |
| 19 | 8.9 | 23 | 2.1 | 4.5 | 1.8 | 1.30 | Example |
| 20 | 8.8 | 22 | 2.1 | 4.8 | 1.9 | 1.36 | Example |
| 21 | 6.7 | 23 | 2.0 | 4.3 | 1.4 | 1.03 | Example |
| 22 | 8.4 | 9 | — | — | 1.1 | 0.58 | Example |
| 23 | 8.6 | 9 | 2.2 | 3.9 | 1.1 | 0.58 | Example |
| 24 | 6.0 | 7 | 1.8 | 2.9 | 1.0 | 0.51 | Example |
| 25 | 10.1 | 25 | 1.7 | 3.8 | 2.2 | 1.24 | Example |

*The ratio of X-ray diffraction intensity obtained from the plain in which the <100> direction of crystal grains is preferentially oriented parallel to the circumference direction and the <011> direction of crystal grains is preferentially oriented parallel to the rolling direction of the steel pipe to that obtained for the three-dimensionally randomly oriented sample

**A JIS No. 12 test piece was prepared by cutting out the steel pipe.

***Magnetic flux density measured at a magnetizing force of 200 A/m.

****The $Ac_1$ transformation point cannot be determined because of the extremely low carbon content. (A heat treatment is performed in the range of 550° C. to 900° C. so that the steel is heat-treated in the ferrite single phase.)

*****Maximum relative permeability ratio = maximum relative permeability/maximum relative permeability of standard material In the examples, the <100> direction of crystal grains was preferentially oriented parallel to the circumferential direction, the <011> direction of crystal grains was preferentially oriented parallel to the rolling direction, and the X-ray intensity ratio relative to the three-dimensionally randomly oriented sample was 3.0 or more. Furthermore, the maximum relative permeability ratios of the examples were higher than the maximum relative permeability ratio of the steel pipe as being electric-resistance-welded (steel pipe No. 1). Thus, the steel pipes of the examples exhibited good properties. In the examples, the magnetic flux densities at a low magnetic field (200 A/m) were also higher than the magnetic flux density of the steel pipe as being electric-resistance-welded (steel No. 1).

In particular, in the examples (steel pipe Nos. 11, 13 to 16, 19, 20, 22, 23, and 25), the ratio of X-ray diffraction intensity obtained from the plane in which the <100> direction of crystal grains was preferentially oriented parallel to the circumference direction and the <011> direction of crystal grains was preferentially oriented parallel to the rolling direction of the steel pipes to that obtained for the three-dimensionally randomly oriented sample was 8.0 or more, and the magnetic properties were markedly improved. In the examples (steel pipe Nos. 13, 16, and 25), the ratio was 10.0 or more and the steel pipes exhibited excellent properties. After stretch-reducing, by performing annealing at 550° C. or higher (steel pipe Nos. 15 and 16) or performing cold drawing and annealing at 550° C. or higher (steel pipe No. 13), crystal grains were coarsened and the magnetic properties further improved. In the examples (steel pipe Nos. 19 to 21) in which annealing was performed after stretch-reducing, by decreasing the thickness by 10% to 25% during the stretch-reducing, the magnetic properties were further improved compared with the cases where the thickness was not changed. On the other hand, when only the stretch-reducing was performed without annealing, by increasing the thickness by 10% to 25% during the stretch-reducing, the magnetic properties were further improved compared with the cases where the thickness was not changed. When the ratio of change in thickness exceeded 25%, the effect of improving the magnetic properties was decreased. In addition, in the steel pipes having an r-value in the circumference direction of 1.2 or more and an r-value in the rolling direction of (the r-value in the circumference direction+1.0) or more, the ratio of X-ray diffraction intensity obtained from the plane in which the <100> direction of crystal grains was preferentially oriented parallel to the circumference direction and the <011> direction of crystal grains was preferentially oriented parallel to the rolling direction of the steel pipes to that obtained for the three-dimensionally randomly oriented sample was 3.0 or more, and these steel pipes exhibited good magnetic properties.

In contrast, in the comparative examples, which were out of the range, the ratio of X-ray diffraction intensity obtained from the plane in which the <100> direction of crystal grains was preferentially oriented parallel to the circumference direction and the <011> direction of crystal grains was preferentially oriented parallel to the rolling direction of the steel pipes to that obtained for the three-dimensionally randomly oriented sample was less than 3.0, and the magnetic properties were not improved.

In a comparative example in which the C content was out of the range (steel pipe No. 7), the maximum relative permeability ratio of the steel pipe was low, i.e., 0.8 times the maximum relative permeability ratio of the standard sample of the comparative example (steel pipe No. 1).

In a comparative example in which the diameter decrease ratio in the stretch-reducing was lower than the preferred range (steel pipe No. 10), the maximum relative permeability ratio of the steel pipe was the same level as that of the steel pipe blank in the comparative example (steel pipe No. 1), and no improvement was observed. In a comparative example in which the rolling finishing temperature in the stretch-reducing was higher than the preferred range (steel pipe No. 12), the maximum relative permeability ratio of the steel pipe was the same level as that of the steel pipe blank (steel pipe No. 1), and no improvement was observed. In a comparative example in which the temperature of annealing performed after the stretch-reducing was higher than the preferred range (steel pipes No. 17 and 18), the grains were grown and the maximum relative permeability ratios of the steel pipes were higher than the maximum relative permeability ratio of the steel pipe blank (steel pipe No. 1), but the X-ray intensity ratio relative to the three-dimensionally randomly oriented sample was less than 3.0. This result shows that the crystal orientation formed during the stretch-reducing was disordered and oriented in random directions. Accordingly, the magnetic flux densities at 200 A/m of the steel pipe Nos. 17 and 18 (comparative examples) were substantially the same as the magnetic flux density of the steel pipe blank (steel pipe No. 1). Unlike the steel pipes Nos. 15 and 16 (examples), a significant improvement in the magnetic properties was not observed in the steel pipe Nos. 17 and 18 (comparative examples).

Example 2

Thin steel strips having the high-purity compositions shown in Table 3 were roll-formed to prepare open pipes, and the ends of the open pipes were joined by electric resistance welding to prepare electric-resistance-welded steel pipes. These electric-resistance-welded steel pipes were used as steel pipe blanks.

The steel pipe blanks were heated to 900° C. to 1,000° C., and were then stretch-reduced under the conditions (diameter decrease ratio, thickness decrease (−) ratio/thickness increase (+) ratio, and rolling finishing temperature) shown in Tables 4-1 and 4-2. Some of the prepared steel pipes were then cold-drawn and/or annealed. In the cold drawing, the area decrease ratio was 30%. The annealing was performed at a temperature in the range of 650° C. to 950° C.

The measurement of magnetic properties, the examination of structures, and the measurement of the r-value were performed using the prepared steel pipes. The measurement methods were as follows and substantially the same as those in Example 1.

(1) Magnetic Properties

Each of the prepared steel pipes was cut into a ring having a length in the range of 5 to 10 mm, and the cut surface was polished. The number of primary windings was 250 and the number of secondary windings was 100. The direct current magnetization characteristics of the samples were measured. The permeability was measured while applying a magnetizing force up to 10,000 A/m. The maximum (maximum permeability) was determined to calculate the maximum relative permeability. Furthermore, the magnetic flux density at a magnetizing force of 200 A/m was evaluated. The measurement was performed after scales were removed by pickling.

(2) Examination of Structure

The crystal grain size and the crystal orientation of the prepared steel pipes were measured.

The cross section of each steel pipe was etched with etchants, and the structure was observed with a microscope. The crystal grain size was calculated by the crossed straight line segment method. Nital and picral, or nital and a saturated aqueous solution of picric acid were used as the etchants. Each test piece was alternately immersed in both etchants so that the structure was visible, and the grain size was measured. In the measurement of the grain size, only grain boundaries that can be clearly distinguished (high-angle grain boundaries) were used for the measurement, and grain boundaries that were very lightly corroded, just like a spider's thread, were ignored.

The measurement position was the center of the wall in the thickness direction, i.e., the part other than the surface layers disposed within 100 μm from the surfaces. The total length of line segments of 200 crystal grains was measured in a direction parallel to the surface layer of each steel pipe. The grain size was calculated by dividing the length of the line segments by the number of ferrite grains and was defined as the average crystal grain size. Regarding test pieces that apparently had an average crystal grain size of more than 100 μm, the accurate grain sizes were not measured, and expressed as more than 100 μm (>100 μm). The crystal grains of annealed steel pipes were ordered grains. Regarding the steel pipes having a high-purity composition, in contrast, the steel pipes as being stretch-reduced had a structure in which crystal grains expanded in the direction of the wall thickness (from the outside of the steel pipe to the inside thereof).

The crystal orientation was determined by measuring the X-ray intensity ratio relative to a three-dimensionally randomly oriented sample by X-ray diffractometry. A flat steel plate was prepared by expanding each steel pipe. Subsequently, 500 μm or more of the surface layer of the steel plate was removed by polishing. Thus, a test piece having a mirror-finished surface was prepared from substantially the center of the wall thickness of the steel pipe. Furthermore, the test piece was subjected to chemical polishing (etchant: 2% to 3% hydrofluoric acid and aqueous hydrogen peroxide) to remove working strain due to the polishing.

An incomplete pole figure of the prepared test piece was measured by a reflection method using an X-ray diffractometer. The integrated intensity of the crystal orientation in which the <100> direction of crystal grains was preferentially oriented parallel to the circumferential direction of the steel pipe, and the <011> direction of crystal grains was preferentially oriented parallel to the rolling direction thereof was normalized by the intensity of the randomly oriented sample on the basis of the results. Thus, the X-ray intensity ratio relative to the three-dimensionally randomly oriented sample was determined. The X-ray source used was CuKα.

(3) Measurement of r-Value

The r-value was evaluated using arcuate test pieces (JIS No. 12 test pieces) prepared by cutting out from each steel pipe. As in the above-described measurement method, strain gauges were applied on each test piece, and strains in the circumference direction and in the rolling direction were measured. The r-value was calculated from the strain at an elongation in the range of 7% to 8%.

The results are shown in Tables 4-1 and 4-2.

TABLE 3

| Steel sheet | Chemical components (mass %) | | | | | | | | |
|---|---|---|---|---|---|---|---|---|---|
| No. | C | Si | Mn | P | S | Al | N | Others | Fe |
| AA | 0.0019 | 0.01 | 0.16 | 0.011 | 0.007 | 0.036 | 0.0021 | Ti: 0.03, Nb: 0.006 | 99.7(Bal.) |
| AB | 0.0010 | 0.02 | 0.22 | 0.008 | 0.005 | 0.025 | 0.0018 | Ti: 0.01 | 99.7 |
| AC | 0.0039 | 0.01 | 0.35 | 0.018 | 0.011 | 0.028 | 0.0040 | Ti: 0.09 | 99.5 |
| AD | 0.0015 | 2.8 | 0.18 | 0.008 | <0.001 | 0.27 | 0.0020 | — | 96.7 |
| AE | 0.0013 | 0.01 | 0.15 | 0.019 | 0.006 | 0.034 | 0.0019 | Cr: 1.5 | 98.3 |

TABLE 4-1

| Steel pipe No. | Steel sheet No. | $Ac_1$ ° C. | Steel pipe blank Type | Stretch-reducing: Diameter decrease ratio % | Stretch-reducing: Rolling finishing temperature ° C. | Stretch-reducing: Ratio of change in thickness % | Cold drawing ratio % | Annealing temperature ° C. |
|---|---|---|---|---|---|---|---|---|
| 2-1 | AA | 900 | ERW steel pipe | 62 | 760 | 7 | — | — |
| 2-2 | AA | 900 | ERW steel pipe | 62 | 760 | 7 | — | 800 |
| 2-3 | AA | 900 | ERW steel pipe | 62 | 760 | 7 | — | 850 |
| 2-4 | AA | 900 | ERW steel pipe | 62 | 760 | 7 | — | 875 |
| 2-5 | AA | 900 | ERW steel pipe | 62 | 760 | 7 | — | 950 |
| 2-6 | AA | 900 | ERW steel pipe | 62 | 840 | 7 | — | 650 |
| 2-7 | AA | 900 | ERW steel pipe | 62 | 840 | 7 | — | 750 |
| 2-8 | AA | 900 | ERW steel pipe | 62 | 840 | 7 | — | 800 |
| 2-9 | AA | 900 | ERW steel pipe | 62 | 840 | 7 | — | 850 |
| 2-10 | AA | 900 | ERW steel pipe | 62 | 750 | −13 | — | 800 |
| 2-11 | AA | 900 | ERW steel pipe | 62 | 760 | −13 | — | 950 |
| 2-12 | AA | 900 | ERW steel pipe | 62 | 680 | −13 | — | — |
| 2-13 | AA | 900 | ERW steel pipe | 62 | 680 | −13 | — | 800 |
| 2-14 | AA | 900 | ERW steel pipe | — | — | — | — | — |
| 2-15 | AA | 900 | ERW steel pipe | — | — | — | — | 800 |
| 2-16 | AA | 900 | ERW steel pipe | — | — | — | — | 920 |

| Steel pipe No. | Structure: Intensity ratio relative to three-dimensionally randomly oriented sample** | Structure: Average crystal grain size μm | r-value Rolling direction**** | Magnetic properties: Maximum relative permeability | Magnetic properties: Magnetic Flux density*** T | Remarks |
|---|---|---|---|---|---|---|
| 2-1 | 7.3 | >50* | 5.2 | 2810 | 0.8 | Example |
| 2-2 | 8.9 | 32 | ≧8~10 | 10090 | 1.4 | Example |
| 2-3 | 9.2 | 35 | ≧8~10 | 10930 | 1.4 | Example |
| 2-4 | 9.4 | 41 | ≧8~10 | 12300 | 1.5 | Example |
| 2-5 | 1.4 | >100 | 1.1 | 6230 | 0.7 | Comparative Example |
| 2-6 | 7.5 | 19 | 5.4 | 3030 | 0.9 | Example |
| 2-7 | 8.4 | 39 | ≧8~10 | 10010 | 1.2 | Example |
| 2-8 | 9.3 | 43 | ≧8~10 | 11500 | 1.5 | Example |
| 2-9 | 9.6 | 50 | ≧8~10 | 13090 | 1.6 | Example |
| 2-10 | 9.2 | 38 | ≧8~10 | 10940 | 1.5 | Example |
| 2-11 | 1.3 | >100 | 1.2 | 6400 | 0.7 | Comparative Example |
| 2-12 | 6.4 | >50* | 1.9 | 1720 | 0.4 | Example |
| 2-13 | 8.1 | 30 | 2.8 | 4780 | 0.9 | Example |
| 2-14 | 1.0 | 25 | 0.9 | 2310 | 0.2 | Comparative Example |
| 2-15 | 1.0 | 29 | 1.0 | 3080 | 0.6 | Comparative Example |
| 2-16 | 1.3 | >100 | 0.9 | 6430 | 0.7 | Comparative Example |

*Grain size in the direction of wall thickness (crystal grains expanding from the outside of the steel pipe to the inside thereof)

**The ratio of X-ray diffraction intensity obtained from the plain in which the <100> direction of crystal grains is preferentially oriented parallel to the circumference direction and the <011> direction of crystal grains is preferentially oriented parallel to the rolling direction of the steel pipe to that obtained for the three-dimensionally randomly oriented sample

***Magnetic flux density measured at a magnetizing force of 200 A/m

****A JIS No. 12 test piece (arcuate test piece) was cut out from the steel pipe and used for the measurement.

TABLE 4-2

| Steel pipe No. | Steel sheet No. | $Ac_1$ ° C. | Steel pipe blank Type | Stretch-reducing: Diameter decrease ratio % | Stretch-reducing: Rolling finishing temperature ° C. | Stretch-reducing: Ratio of change in thickness % | Cold drawing ratio % | Annealing temperature ° C. |
|---|---|---|---|---|---|---|---|---|
| 2-17 | AB | 900 | ERW steel pipe | 70 | 700 | ≦±3 | — | 800 |
| 2-18 | AB | 900 | ERW steel pipe | 70 | 840 | ≦±3 | — | 800 |
| 2-19 | AB | 900 | ERW steel pipe | 50 | 840 | ≦±3 | — | 800 |
| 2-20 | AB | 900 | ERW steel pipe | 15 | 840 | ≦±3 | — | 820 |
| 2-21 | AB | 900 | ERW steel pipe | 8 | 840 | ≦±3 | — | 850 |
| 2-22 | AB | 900 | ERW steel pipe | 70 | 880 | ≦±3 | — | 800 |

TABLE 4-2-continued

| | | | | | | | | |
|---|---|---|---|---|---|---|---|---|
| 2-23 | AB | 900 | ERW steel pipe | 70 | 930 | ≦±3 | — | 850 |
| 2-24 | AB | 900 | ERW steel pipe | — | — | — | — | 800 |
| 2-25 | AB | 900 | ERW steel pipe | — | — | — | — | 940 |
| 2-26 | AC | 900 | ERW steel pipe | 75 | 850 | ≦±3 | — | 800 |
| 2-27 | AC | 900 | ERW steel pipe | 75 | 850 | ≦±3 | 30 | 800 |
| 2-28 | AD | α single phase | ERW steel pipe | 75 | 850 | ≦±3 | — | 750 |
| 2-29 | AE | 900 | ERW steel pipe | 62 | 830 | ≦±3 | — | 850 |

| | Structure | | | Magnetic properties | | |
|---|---|---|---|---|---|---|
| Steel pipe No. | Intensity ratio relative to three-dimensionally randomly oriented sample** | Average crystal grain size μm | r-value Rolling direction**** | Maximum relative permeability | Magnetic flux density*** T | Remarks |
| 2-17 | 7.7 | 31 | 2.9 | 5440 | 0.9 | Example |
| 2-18 | 9.3 | 44 | ≧8~10 | 12200 | 1.5 | Example |
| 2-19 | 9.1 | 43 | ≧8~10 | 9900 | 1.3 | Example |
| 2-20 | 8.8 | 44 | ≧8~10 | 7620 | 1.1 | Example |
| 2-21 | 9.3 | 40 | 4.9 | 4920 | 0.8 | Example |
| 2-22 | 5.9 | 47 | ≧8~10 | 13400 | 1.8 | Example |
| 2-23 | 1.8 | 69 | 1.2 | 4310 | 0.5 | Comparative Example |
| 2-24 | 1.1 | 35 | 0.9 | 3240 | 0.3 | Comparative Example |
| 2-25 | 1.2 | >100 | 1.3 | 6610 | 0.7 | Comparative Example |
| 2-26 | 8.4 | 48 | ≧8~10 | 10040 | 1.2 | Example |
| 2-27 | 8.7 | 51 | ≧8~10 | 10590 | 1.3 | Example |
| 2-28 | 9.5 | >100 | ≧8~10 | 61280 | 1.9 | Example |
| 2-29 | 8.9 | 41 | ≧8~10 | 11500 | 1.7 | Example |

*Grain size in the direction of wall thickness (crystal grains expanding from the outside of the steel pipe to the inside thereof)

**The ratio of X-ray diffraction intensity obtained from the plain in which the <100> direction of crystal grains is preferentially oriented parallel to the circumference direction and the <011> direction of crystal grains is preferentially oriented parallel to the rolling direction of the steel pipe to that obtained for the three-dimensionally randomly oriented sample

***Magnetic flux density measured at a magnetizing force of 200 A/m

****A JIS No. 12 test piece (arcuate test piece) was cut out from the steel pipe and used for the measurement.

All the steel pipes of the examples had a high-purity composition containing less than 0.01% of C and 95% or more of Fe. In the steel pipes of the examples, the <100> direction of crystal grains was preferentially oriented parallel to the circumferential direction, the <011> direction of crystal grains was preferentially oriented parallel to the rolling direction, and the X-ray intensity ratio relative to the three-dimensionally randomly oriented sample was 3.0 or more. These steel pipes had a maximum relative permeability of 2,500 or more and a magnetic flux density at a low magnetic field (200 A/m) of 0.8 T or more, and had good magnetic properties. In addition, the steel pipes of the examples had an average crystal grain size of 20 μm or more and an r-value in the rolling direction of 2.0 or more. When the average crystal grain size was 20 μm or more and the r-value in the rolling direction was 2.0 or more, satisfactory magnetic properties were generally exhibited.

In particular, the examples in which annealing was performed after stretch-reducing (steel pipe Nos. 2-2 to 2-4, Nos. 2-7 to 2-10, Nos. 2-18 to 2-20, No. 2-22, No. 2-26, No. 2-27, No. 2-28, and No. 2-29) had a maximum relative permeability of 7,500 or more and a magnetic flux density at a low magnetic field (200 A/m) of 1.0 T or more, and thus had excellent magnetic properties.

In the example having high contents of Si and Al (steel pipe No. 2-28) had a maximum relative permeability of 61,280 and a magnetic flux density at a low magnetic field (200 A/m) of 1.9 T. Thus, the magnetic properties were markedly improved. The maximum relative permeability and the magnetic flux density at a low magnetic field (200 A/m) of the example containing 1.5% of Cr (steel pipe No. 2-29) were substantially the same as those of the examples that did not contain Cr (steel pipe Nos. 2-2 to 2-4 and Nos. 2-7 to 2-10). However, the steel pipe No. 2-29 containing Cr had a core loss of 2.01 W/kg at 400 Hz and at a magnetic flux density of 0.1 T, whereas the steel pipe No. 2-10 not containing Cr had a core loss of 2.48 W/kg. Accordingly, when the steel pipe contains Cr, the magnetic properties in the high-frequency range could be markedly improved. The maximum relative permeability and the magnetic flux density of the example that was subjected to the drawing (steel pipe No. 2-27) were higher than those of the case without drawing (steel pipe No. 2-26).

In examples in which the rolling finishing temperature of the stretch-reducing was out of the preferred range in the steel pipe having a high-purity composition (steel pipe Nos. 2-12, 2-13, and 2-17), the magnetic properties were somewhat degraded. In an example in which the diameter decrease ratio in the stretch-reducing was out of the preferred range (steel pipe No. 2-21), the magnetic properties were somewhat degraded. In examples in which the temperature of annealing performed after the stretch-reducing was out of the preferred range in the steel pipe having a high-purity composition (steel pipe Nos. 2-6 and 2-11), the magnetic properties were somewhat degraded.

In an example as being stretch-reduced (steel pipe No. 2-1), the maximum relative permeability of the steel pipe was higher than that of a comparative example as being electric-resistance-welded that had the same composition (steel pipe No. 2-14) by 20% or more. The magnetic flux density at a low magnetic field (200 A/m) of the steel pipe No. 2-1 was improved to 200% or more of that of the steel pipe No. 2-14. In examples in which annealing was performed after stretch-reducing (for example, steel pipe Nos. 2-7 to 2-10 and steel pipe Nos. 2-17 to 2-22), the maximum relative permeability of the steel pipes were higher than that of comparative examples having the same composition in which annealing was performed after the preparation of the electric-resistance-welded steel pipes (for example, steel pipe No. 2-15 and steel pipe No. 2-24) by 20% or more. The magnetic flux densities at a low magnetic field (200 A/m) of these steel pipes (for example, steel pipe Nos. 2-7 to 2-10 and steel pipe Nos. 2-17 to 2-22) were improved to 200% or more of that of the steel pipe Nos. 2-15 and 2-24.

In the steel pipe No. 2-6 in which the temperature of annealing performed after the stretch-reducing was lower than the preferred range, the magnetic properties were improved compared with the comparative example as being electric-resistance-welded that had the same composition (steel pipe No. 2-14). However, the steel pipe No. 2-6 had a small crystal grain size, and the degree of improvement in the magnetic properties of the steel pipe No. 2-6 was lower than that of comparative examples which had the same composition and in which annealing was performed after the electric-resistance-welded pipes were produced (for example, steel pipe No. 2-15 and steel pipe No. 2-16). In the example in which the rolling finishing temperature of the stretch-reducing was out of the preferred range (the steel pipe that was annealed after stretch-reducing) (steel pipe No. 2-17), the maximum relative permeability was somewhat decreased but the magnetic flux density was improved, as compared with a comparative example that had the same composition and that was annealed after the production of the electric-resistance-welded pipe (steel pipe No. 2-25). The reason for this as follows. In the steel pipe No. 2-25, although crystal grains were grown by the heat treatment (annealing) after the production of the electric-resistance-welded pipe, the orientation of the crystal grains were insufficient because the stretch-reducing was not performed.

In comparative examples in which the X-ray intensity ratio relative to the three-dimensionally randomly oriented sample was out of our range, i.e., less than 3.0, the maximum relative permeability or the magnetic flux density at a low magnetic field (200 A/m) was lower than that of the examples, and thus the magnetic properties of the comparative examples were degraded.

In steel pipes No. 2-5 and 2-11 of the comparative examples, the heating temperature during annealing after stretch-reducing was higher than our preferred range, and these steel pipes were heated to the austenite single phase region. Consequently, the crystal orientation formed during the stretch-reducing was disordered and oriented in random directions. Accordingly, the X-ray intensity ratio relative to the three-dimensionally randomly oriented sample was less than 3.0, and the magnetic properties were degraded. In a steel pipe No. 2-23 of a comparative example, the rolling finishing temperature of the stretch-reducing was high. Accordingly, the X-ray intensity ratio relative to the three-dimensionally randomly oriented sample was less than 3.0, and the magnetic properties were degraded.

INDUSTRIAL APPLICABILITY

A steel pipe with good magnetic properties having satisfactory soft magnetic properties for materials used for a magnetic shield or a motor can be easily produced at low cost, and industrially significant advantages can be provided.

The invention claimed is:

1. A steel pipe with good magnetic properties comprising a composition containing less than 0.01% C and 95% or more Fe in terms of mass percent, has a structure in which a ratio of X-ray diffraction intensity from 1) a plane in which the <100> direction of crystal grains is mostly oriented parallel to a circumference direction and the <011> direction of crystal grains is mostly oriented parallel to a rolling direction of the steel pipe to 2) a three-dimensionally randomly oriented sample is 3.0 or more, and has a maximum relative permeability of 2500 or more and a magnetic flux density under a magnetic field condition with a magnetizing force of 200 A/m of 0.8 T or more.

2. The steel pipe according to claim 1, having an r-value in the rolling direction of 2.0 or more.

3. The steel pipe according to claim 1, wherein the structure has an average crystal grain size of 20 μm or more.

4. The steel pipe according to claim 1, wherein the composition comprises less than 0.01% C, 0.45% or less Si, 0.1% to 1.4% Mn, about 0.01% or less S, 0.025% or less P, 0.01% to 0.06% Al, and 0.005% or less N in terms of mass percent, the balance being Fe, and inevitable impurities.

5. The steel pipe according to claim 1, wherein the composition comprises less that 0.01% C, more than 0.45% and 3.5% or less Si, 0.1% to 1.4% Mn, 0.01% or less S, 0.025% or less P, more than 0.06% and 0.5% or less Al, and 0.005% or less N in terms of mass percent, the balance being Fe, and inevitable impurities.

6. The steel pipe according to claim 4, wherein the composition further comprises at least one group selected from the following Groups D to F in terms of mass percent:

Group D: at least one selected from 0.05% or less Ti, 0.05% or less Nb, and 0.005% or less B;

Group E: at least one selected from 5% or less Cr, 5% or less Ni, and 0.05% or less Mo; and Group F: at least one of 0.005% or less Ca and 0.05% or less REM.

* * * * *